US006617778B2

(12) United States Patent
Choi

(10) Patent No.: US 6,617,778 B2
(45) Date of Patent: Sep. 9, 2003

(54) ELECTRON GUN ASSEMBLY FOR A COLOR CATHODE RAY TUBE

(75) Inventor: Jin-Yeal Choi, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/855,759

(22) Filed: May 16, 2001

(65) Prior Publication Data

US 2002/0005690 A1 Jan. 17, 2002

(30) Foreign Application Priority Data

May 17, 2000 (KR) ..... 2000-26282

(51) Int. Cl.[7] ..... H01J 29/50
(52) U.S. Cl. ..... 313/414; 313/447; 313/409
(58) Field of Search ..... 313/414, 409, 313/412, 413, 415, 447, 448, 452; 335/212

(56) References Cited

U.S. PATENT DOCUMENTS 4,742,266 A * 5/1988 New ..... 313/414
5,350,967 A * 9/1994 Chen ..... 313/413

* cited by examiner

*Primary Examiner*—Sharlene Leurig
(74) *Attorney, Agent, or Firm*—Fleshner & Kim, LLP

(57) ABSTRACT

The present invention discloses an electron gun assembly for color cathode ray tube capable of preventing a moiré phenomenon and improving the resolution. As a construction for realizing the electron gun assembly of the present invention, the electron gun assembly comprises a series of orderly arranged electrodes including a control electrode, an accelerating electrode, the third grid electrode and the fourth, plate-shaped grid electrode having a predetermined thickness in order to form, focus and accelerate the electron beams by inducing electrons emitted from cathodes constituting a triode portion to pass electron beam passing apertures, said accelerating electrode is provided with a recess which has a both-side peripheral portion width B in its horizontal direction elongated, compared to its vertical direction width W with respect to the electron beam passing aperture having a predetermined diameter A and which has a predetermined depth D in the third grid electrode direction, and a shape of the accelerating electrode and the fourth grid electrode satisfies the following equation:

$$2.8\ \text{mm} \leq D/W + T/A \leq 3.2\ \text{mm}$$

Therefore, in accordance with the present invention, the relationship between the recess depth of the accelerating electrode and its vertical direction width as well as ratio between the diameter of the electron beam passing aperture and the thickness of the fourth grid electrode can be formed to be positioned within a required range, thereby preventing a deterioration in accordance with the focus characteristics of the electron beam and a moiré phenomenon on the overall region of the screen and thus realizing a high quality image.

17 Claims, 5 Drawing Sheets

[FIG.1]
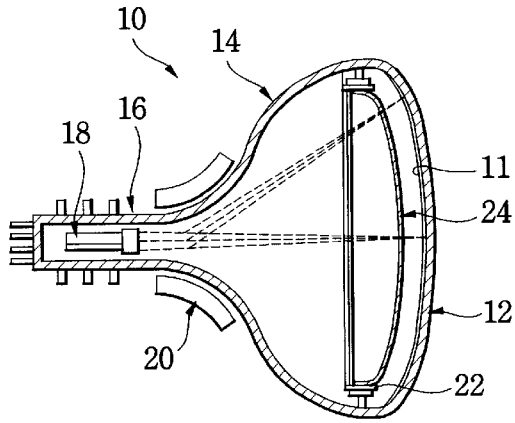
[FIG.2]
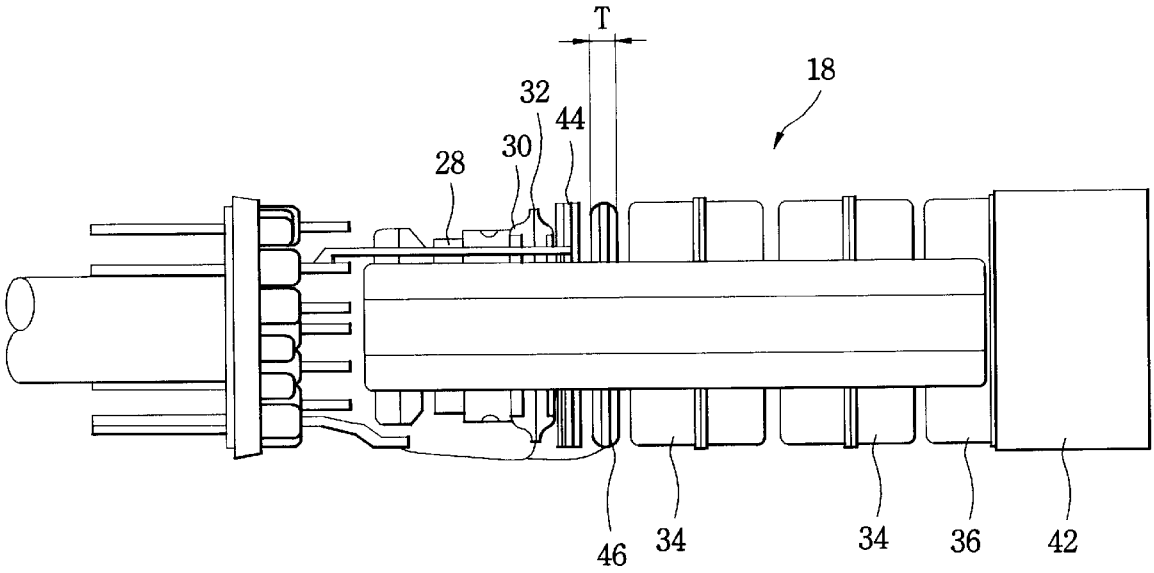

[FIG.3]
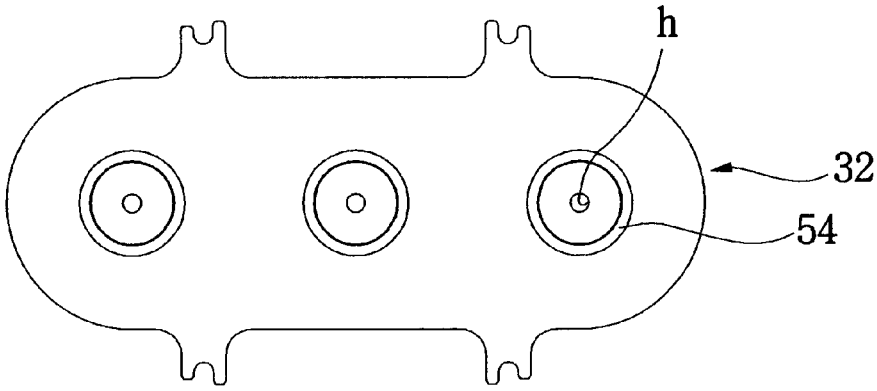
[FIG.4]
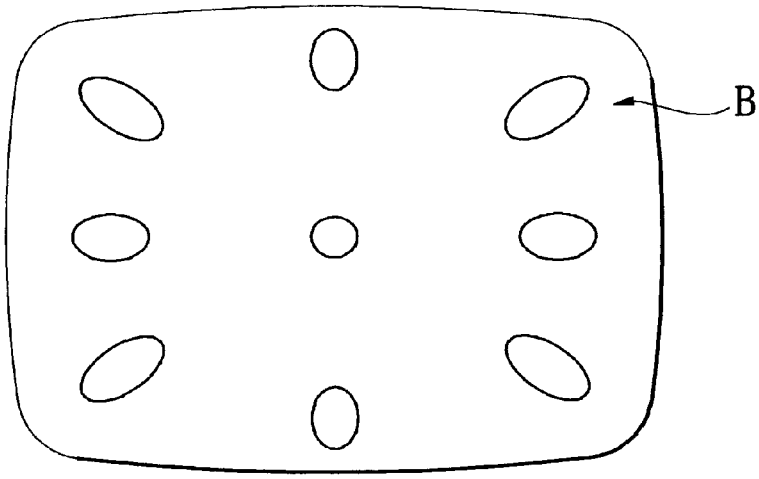

[FIG.5]
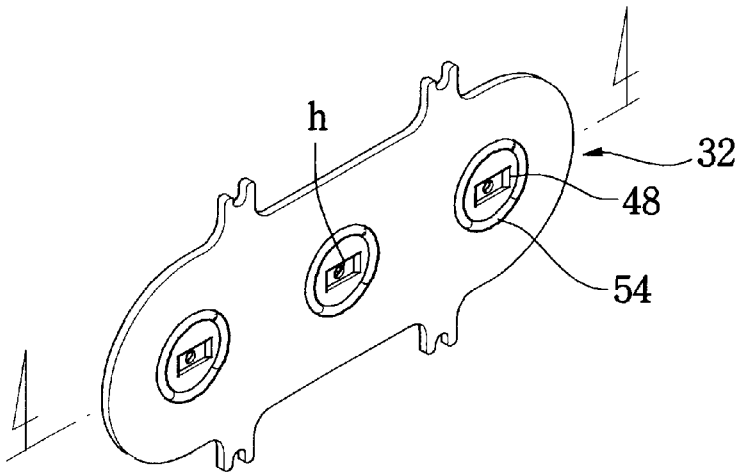
[FIG.6]
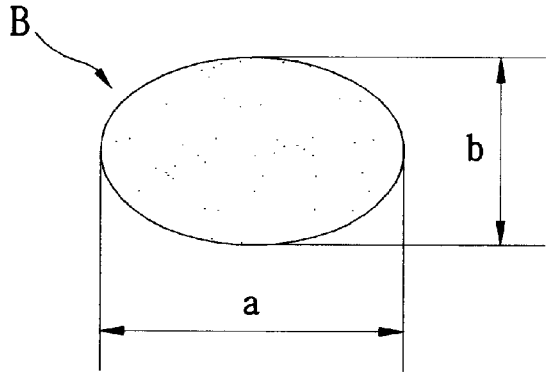

[FIG.7]
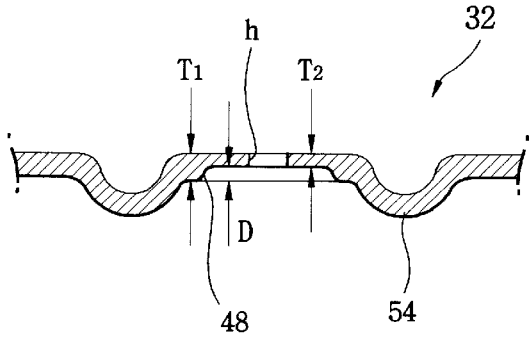
[FIG.8]
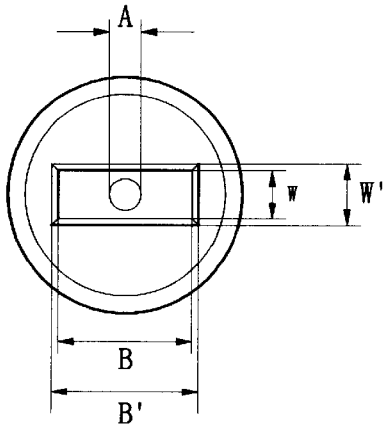
[FIG.9]
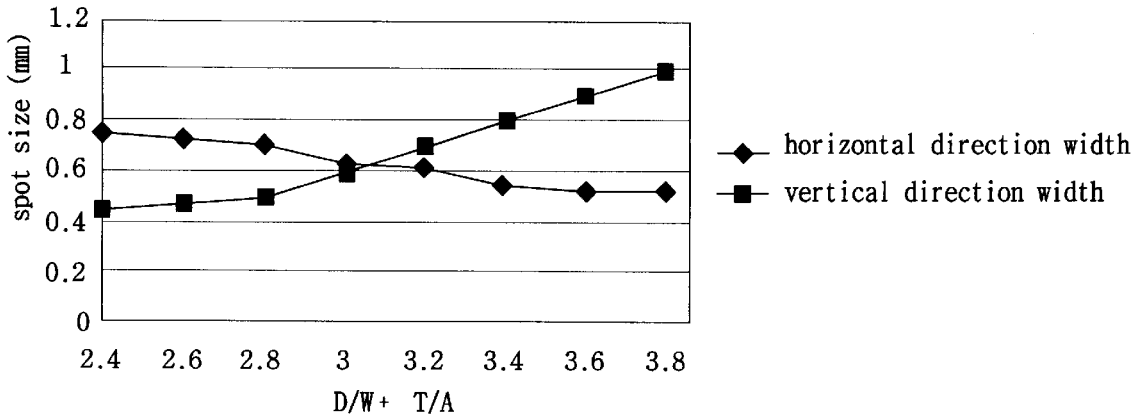

[FIG. 10]
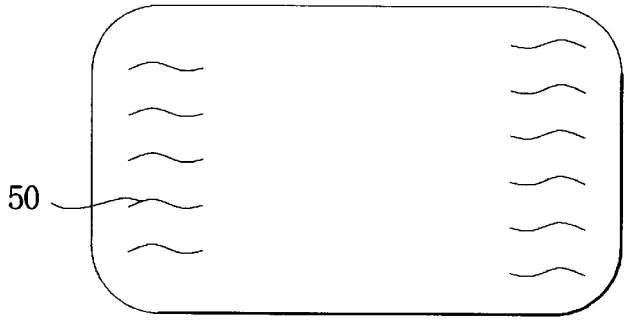
[FIG. 11]
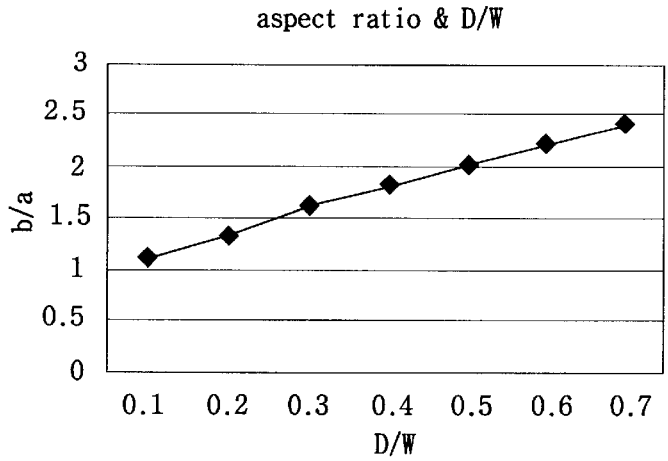
[FIG. 12]
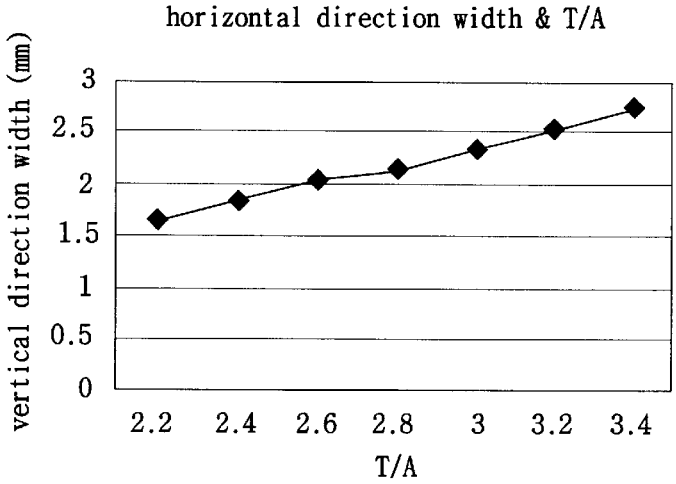

ELECTRON GUN ASSEMBLY FOR A COLOR CATHODE RAY TUBE

BACKGROUND OF THE INVENTION

1. Field of the Invention

The present invention relates to an electron gun assembly for a color cathode ray tube, and more particularly to an electron gun assembly capable of improving its focus characteristics and preventing a moiré phenomenon on the overall region of the screen, thereby realizing a high quality image.

2. Description of the Related Art

In general, a cathode ray tube is a display device which is used in the fields of a television receiver; an oscilloscope, a radar viewing device, etc. and which displays an image on the front surface of a panel by controlling electron beams emitted from the electron gun assembly so as to impinge phosphors deposited on an inner surface of the panel of the tube, depending on received image signals.

As a construction of such a color cathode ray tube, as shown in FIG. 1, the tube 10 comprises a panel 12 having phosphors screen deposited on the inner surface thereof for emitting dotted light in three colors of blue, green and red and a funnel 14 integrally connected with the panel 12 thereby to form a vacuum envelop.

Also, an electron gun assembly 18 is provided in a neck portion 16 of the funnel 14 so as to emit electron beams arranged in line and consisting of a center beam and a pair of side beams that pass on the same horizontal plane. Three electron beams emitted from the electron gun assembly 18 are deflected by a horizontal and vertical magnetic fields generated by a deflection yoke 20 which is installed outside the funnel 14.

Further, a shadow mask 24 functioning as a color selection means is installed into the panel 12 to be spaced at a given distance from the inner surface of the panel 12, with being supported by a frame portion 22.

In such construction of the color cathode ray tube 10, the electron gun assembly 18 comprises a cathode 28 constituting a triode portion and a series of electrodes arranged orderly toward the cathode 28, as shown in FIG. 2.

More specifically, the electron gun assembly 18 comprises a control electrode 30 and an accelerating electrode 32 arranged orderly for focusing and accelerating electrons emitted from cathode 28 so as to form electron beams. These electron beams are then greatly focused by a prefocusing lens formed of the potential difference of the third grid electrode 44, the fourth grid electrode 46 and a focusing electrode 34 which are arranged orderly.

Also, an anode electrode 36 arranged next to the focusing electrode 34 forms a main lens that is formed by a potential difference applied between the focusing electrode 34 and the anode electrode 34. The electron beams passing through the main lens 42 are focused more sharply and then accelerated so as to form an electron beam spot, which will be then forwarded to the phosphor screen deposited on the inner surface of the panel 12.

Since the lens region of the accelerating electrode 32 with respect to the respective cathode 28 is more elongated in the horizontal direction than in the vertical direction due to the in-line arrangement of the respective cathode 28 as shown in FIG. 3, a shape of the electron beam spot is subject to a focusing deterioration in the peripheral portion of the panel 12 as shown in FIG. 4.

In order to prevent the focusing deterioration, according to Japanese Patent Application KOKAI Publication No. Sho 53-18866, as shown in FIG. 5, there is provided a groove, that is, a recess 48 elongated in the horizontal direction along the peripheral portion of the electron beam passing aperture (h) of the accelerating electrode 32 in the direction of the third grid electrode 44 so that the lens region in the horizontal direction with respect to the respective electron beam passing aperture (h) can be narrowed.

The recess 48 allows the depth of the electrode thickness direction to be large and thus the width of the electron beam spot shape before incidence upon the main lens to be elongated in the horizontal direction as shown in FIG. 6, thereby making the electron beams have a large astigmatism and preventing a deflection aberration.

Additionally explaining, an aspect ratio (b/a) in accordance with the horizontal elongation of the electron beam is closely related to the difference between the vertical direction thickness and the horizontal direction thickness of the electron beam passing aperture (h) in accordance with the depth of the recess 48 as shown in FIG. 7 or FIG. 8.

As shown in FIG. 6, the length (b) of the vertical direction width and the length (a) of the horizontal direction width of the electron beam are closely related to the diameter of the electron beam passing aperture (h) and the thickness of the fourth grid electrode 46, and the relationship between the aspect ratio (b/a) before incidence upon the main lens and its size affects the size of the electron beam spot on the overall region of the screen and thus the resolution and moiré as shown as an experimental value in FIG. 9.

Herein, moiré is a phenomenon that if the electron beam spot diameter bercomes smaller than a value determined by a periodic structure of phosphor dots, the periodic structure of the phosphor dots and electron beam scanning lines (or periodic video signal) are interfered with each other to thereby cause a stripe pattern 50 on the screen as shown in FIG. 10. This moiré phenomenon also occurs in such a manner that the horizontal direction of the screen is inclined toward the center direction to thereby cause a distortion of the screen (this is referred to as a video moiré).

Again, with respect to the above-described Japanese Patent Application KOKAI Publication No. Sho 53-18866, this reference uses only a recess 48 having a large depth to adjust the aspect ratio of the electron beam before incidence upon the main lens to thereby reduce the deflection aberration and thus to prevent a deterioration of the electron beam spot on the center of the screen as can be seen from its invention spirit. However; this may cause a large blooming of the vertical direction diameter of the electron beam spot in the center of the screen due to astigmatism and thus a video moiréon the overall region of the screen.

As a result, such a technique for controlling the lens region of the respective electron beams by forming the recess 48 on the accelerating electrode 32 has a problem that cannot solve a moiré phenomenon as well as deterioration due to the electron beam spot.

SUMMARY OF THE INVENTION

Accordingly, the present invention has been made in order to solve the above problem, and an object of providing an electron gun assembly for a color cathode ray tube capable of preventing a deterioration of focus characteristics of the electron beams and a moiré phenomenon thereby realizing a high quality image.

In order to achieve the above object, in an electron gun assembly for a color cathode ray tube according to an embodiment of the present invention comprising a series of orderly arranged electrodes including a control electrode, an accelerating electrode, the third grid electrode and the fourth, plate-shaped grid electrode having a predetermined thickness in order to form, focus and accelerate the electron beams by inducing electrons emitted from cathodes constituting a triode portion to pass electron beam passing apertures, said accelerating electrode is provided with a recess which has a both-side peripheral portion width B in its horizontal direction elongated, compared to its vertical direction width W with respect to the electron beam passing aperture having a predetermined diameter A and which has a predetermined depth D in the third grid electrode direction, and a shape of the accelerating electrode and the fourth grid electrode satisfies the following equation:

$$2.8\ \text{mm} \leq D/W+T/A \leq 3.2\ \text{mm}$$

BRIEF DESCRIPTION OF THE INVENTION

FIG. 1 is a view schematically illustrating a structure of a conventional color cathode ray tube;

FIG. 2 is a plan view illustrating an electron gun assembly in FIG. 1;

FIG. 3 is a partially exploded perspective view schematically illustrating a conventional accelerating electrode and its lens region;

FIG. 4 is a top view illustrating an electron beam spot shape in entire region of screen according to the accelerating electrode in FIG. 3;

FIG. 5 is a partially exploded perspective view illustrating a structure of an accelerating electrode having a recess according to a prior art;

FIG. 6 is a top view illustrating an aspect ratio relationship of an electron beam spot of the recess in FIG. 5;

FIG. 7 is a cross-sectional view illustrating the width relationship in accordance with the depth of the recess in FIG. 5;

FIG. 8 is a top view illustrating a relationship between the vertical-direction width length and the horizontal-direction width length of the recess in FIG. 5;

FIG. 9 is a graph view illustrating experiment values when measured a variant scope of electron spot diameter depending on the thickness of the fourth grid electrode, the depth to width of the recess and a variance of the electron beam passing aperture;

FIG. 10 is a top view schematically illustrating a raster moiré phenomenon generated by the recess in FIG. 5;

FIG. 11 is a graph view illustrating experiment values of the aspect ratio relationship of the electron beam spot with respect to the relationship between the depth and the vertical direction width of the recess; and FIG. 12 is a graph view illustrating experiment values of the variance relationship of the horizontal direction width of the electron beam spot depending on the thickness of the fourth grid electrode and the diameter of the electron beam passing aperture.

DETAILED DESCRIPTION OF THE PREFERRED EMBODIMENT

Now, the preferred embodiment of the present invention will be described in detail in reference to the accompanying drawings.

FIG. 11 is a graph view illustrating experiment values of the aspect ratio relationship of the electron beam spot with respect to the relationship between the depth and the vertical direction width of the recess, and FIG. 12 is a graph view illustrating experiment values of the variance relationship of the horizontal direction width of the electron beam spot depending on the thickness of the fourth grid electrode and the diameter of the electron beam passing aperture. Components similar to those of the prior art throughout the figures are designated by like reference numerals, and accordingly the detailed description for them will be omitted.

Similar to the prior art, the electron gun assembly for a color cathode ray tube according to the present invention comprises a cathode 28 constituting a triode plate, and a series of electrodes orderly arranged toward the cathode 28 along its longitudinal direction.

The accelerating electrode 32 among the above respective electrodes is plate-shaped and A has a predetermined thickness T1 as shown in FIG. 7. Also, the accelerating electrode 32 is provided with an electron beam-passing aperture (h) having a predetermined diameter A in its center portion to be coincident with the cathode 28.

A coining portion 54 having a circular arc configuration is formed along the peripheral portion of the electron beam passing aperture (h) in order to minimize the diameter A of the electron beam passing aperture (h), a pressing degree and any deformation thereof Also, there is provided with a recess 48 which is horizontally elongated (that is, its both-side horizontal width B is more elongated, compared to its vertical width W) with respect to the electron beam passing aperture (h) and which has a given depth D toward the third grid electrode 44 in the inner side of the coining portion 54.

The depth D of the recess 48 is preferably defined by the thickness difference obtained by subtracting the thickness T2 of a portion forming the recess 48 from the thickness T1 of the edge portion of the acceleration electrode 32.

In general, if the electron beam spot diameter is more than 0.6 mm, there does not occur a moire phenomenon in which a strip pattern occurs on the screen due to interference between a periodic structure of the phosphor dots and scanning lines of the beam, a periodic video signal or a deflection signal, thereby deteriorating the resolution.

Therefore, in order to prevent a video or a raster moiré 50, the horizontal direction diameter of the electron beam spot in the center region of the screen should be more than 0.6 mm and the vertical direction average diameter of the electron beam spot in the center of the screen should be less than 0.7 mm in order to maintain the resolution.

Accordingly, if an aspect ratio (b/a) of the electron beam before incidence upon the main lens for adjusting the size of the electron beam spot diameter is given as 1.4–1.8 considering the center and peripheral portion of the screen and the size of the horizontal direction electron beam having the diameter of the electron beam spot becoming relatively large before incidence upon the main lens is given as 1.8–2.4 mm considering the spherical aberration of the main lens, the diameter of the electron beam in the center of the screen can be satisfied.

According to the experiment values in FIG. 11, if the length of the vertical direction width of the electron beam before incidence upon the main lens is (b) and the length of the horizontal direction width is (a), the diameter of the electron beam passing aperture (h) of the accelerating electrode 32 is A and the thickness of the fourth grid electrode 46 is T, the focusing characteristics of the triode portion and the electrostatic lens of the pre-focusing portion may be reduced overall in diameters of the horizontal and vertical direction when the size A of the electron beam passing aperture of the accelerating electrode 32 is small and the thickness of the fourth grid electrode 46 is thick.

Also, as the aspect ratio (b/a) of the electron beam before incidence upon the main lens, it is defined that the depth of the recess 48 is D and the length of the vertical width of the recess 48 is W. In this case, the size of the vertical direction of the recess 48 may be defined as W and W' in view of the characteristics of the non-symmetrical electrostatic lens. However, it is noted that the length of the vertical direction of the recess 48 will be defined as W since the size W' is naturally produced when pressing the electrode plate and does not affect the aspect ratio (b/a).

Graphs shown in FIGS. 11 and 12 represent that dimensions as described above can control the size of the electron beam. This can satisfy the aspect ratio 1.6 when D/W is 0.3 mm as shown in FIG. 11 and the horizontal size of 2.1 mm when T/A is 2.8 mm as shown in FIG. 12.

Herein, as described above, in order to satisfy the aspect ratio before incidence upon the main lens and its horizontal size at the same time, it can be understood that they should be in the range of the sum of D/W and T/A.

FIG. 9 shows a horizontal diameter (h) and a vertical diameter (v) on the center region of the screen as an experiment results in which the value of D/W+T/A is given in the range of 2.4–3.8 mm as 0.2 unit. If the value is within the range of 2.8–3.2 mm, the horizontal direction diameter of the electron beam spot on the center region of the screen requires more than 0.6 mm as described above, and the average diameter of the center region of the screen should be less than 0.7 mm so as to maintain the resolution. More specifically, if the value of D/W+T/A is less than 2.8 mm, the horizontal direction diameter of the electron beam spot becomes more than 0.7 mm to thereby affect the resolution and focus characteristics of the tube. If the value of the D/W+T/A is more than 3.2 mm, the vertical direction diameter of the electron beam spot becomes more than 0.7 mm, thereby affecting the resolution and focus characteristics of the tube, similar to that case of the value of D/W+T/A less than 2.8 mm.

On the other hand, if the value of D/W+T/A is less than 2.8 mm, the horizontal direction diameter of the electron beam spot becomes less than 0.6 mm as a result of which the periodic structure of the phosphor dots and the periodic video signal and a deflection signal are interfered with each other to thereby cause a horizontal direction video moiré occurring a stripe pattern on the screen. Also, if the value of D/W+T/A is more than 3.2 mm, the vertical direction diameter of the electron beam spot becomes less than 0.6 mm as a result of which the periodic structure of the phosphor dots and the periodic video signal and a deflection signal are interfered with each other to thereby cause a horizontal direction video moiré occurring a stripe pattern on the screen, similar to the case of the value of D/W+T/A less than 2.8 mm.

Also, when the value of D/W+T/A is within the range of 2.8–3.2, it can be seen that in the center region of the screen as well as in the peripheral portion of the screen because of the horizontal elongation of the electron beam before incident upon the main lens, a halo phenomenon can be suitably removed thereby preventing a moire.

Therefore, in accordance with the present invention, the relationship between the recess depth of the accelerating electrode and its vertical direction width as well as ratio between the diameter of the electron beam passing aperture and the thickness of the fourth grid electrode can be formed to be positioned within a required range, thereby preventing a deterioration in accordance with the focus characteristics of the electron beam and a moiré phenomenon on the overall region of the screen and thus realizing a high quality image.

While the present invention is described with reference to a specific embodiment of the present invention, additional advantages and modifications will readily occur to those skilled in the art. Accordingly, various modifications may be made without departing from the spirit or scope of the general inventive concept as defined by the appended claims and their equivalents.

What is claimed is:

1. An electron gun assembly for a cathode ray tube comprising a plurality of electrodes including a control electrode, an accelerating electrode, a third grid electrode, and a fourth grid electrode having a predetermined thickness in order to form, focus, and accelerate electron beams by inducing electrons emitted from cathodes to pass through electron beam passing apertures, said accelerating electrode being provided with at least one electron beam passing aperture having a recess formed elongated in a horizontal direction with respect to said electron beam passing aperture, wherein the electrode gun assembly satisfies the following equation:

$$2.8 \leq D/W+T/A \leq 3.2$$

where D is a depth of the recess of the accelerating electrode, W is a length of a vertical width of the recess, T is a thickness of the fourth grid electrode, and A is a diameter of the electron beam-passing aperture of the accelerating electrode.

2. The electron gun assembly according to claim 1, wherein the electron gun assembly satisfies the following equation:

$$3.0 \leq D/W+T/A \leq 3.1.$$

3. The electron gun assembly according to claim 1, wherein the accelerating electrode is provided with a plurality of electron beam passing apertures, each having a respective recess formed elongated in a horizontal direction with respect to the respective electron beam passing aperture.

4. The electron gun assembly according to claim 1, wherein the fourth grid electrode is plate shaped.

5. A cathode ray tube comprising the electron gun assembly of claim 1.

6. The cathode ray tube according to claim 5, wherein the cathode ray tube is a color cathode ray tube.

7. An improved electron gun assembly for a cathode ray tube, the electron gun assembly comprising a plurality of electrodes, including a control electrode, an accelerating electrode, a third grid electrode, and a fourth grid electrode arranged in order and configured to focus and accelerate electron beams emitted from cathodes, said accelerating electrode being provided with at least one electron beam passing aperture having a recess formed elongated in a horizontal direction with respect to said electron beam passing aperture, wherein the improvement is such that the electron gun assembly satisfies the following equation:

$$2.8 \leq D/W+T/A \leq 3.2$$

where D is a depth of the recess of the accelerating electrode, W is a vertical width of the recess, T is a thickness of the fourth grid electrode, and A is a diameter of the electron beam passing aperture of the accelerating electrode.

8. The electron gun assembly according to claim 7, wherein the accelerating electrode is provided with a plurality of electron beam passing apertures, each having a respective recess formed elongated in a horizontal direction with respect to the respective electron beam passing aperture.

9. The improved electron gun assembly according to claim 7, wherein the electron gun assembly satisfies the following equation:

$$3.0 \leqq D/W+T/A \leqq 3.1.$$

10. The improved electron gun assembly according to claim 7, wherein the fourth grid electrode is plate shaped.

11. A cathode ray tube comprising the improved electron gun assembly of claim 7.

12. The cathode ray tube according to claim 11, wherein the cathode ray tube is a color cathode ray tube.

13. A cathode ray tube, comprising:

a funnel;

a panel integrally connected with the funnel; and an electron gun assembly disposed in a neck of the funnel, the electron gun assembly comprising:

a plurality of electrodes, including a control electrode, an accelerating electrode, a third grid electrode, and a fourth grid electrode arranged in order and configured to form, focus, and accelerate electron beams emitted from cathodes, said accelerating electrode being provided with at least one electron beam passing aperture having a recess formed elongated in a horizontal direction with respect to said electron beam passing aperture, wherein the electron gun assembly satisfies the following equation:

$$2.8 \leqq D/W+T/A \leqq 3.2$$

where D is a depth of each recess of the accelerating electrode, W is a vertical width of the recess, T is a thickness of the fourth grid electrode, and A is a diameter of the electron beam passing aperture of the accelerating electrode.

14. The electron gun assembly according to claim 13, wherein the accelerating electrode is provided with a plurality of electron beam passing apertures, each having a respective recess formed elongated in a horizontal direction with respect to the respective electron beam passing aperture.

15. The cathode ray tube according to claim 13, wherein the electron gun assembly satisfies the following equation:

$$3.0 \leqq D/W+T/A \leqq 3.2.$$

16. The cathode ray tube according to claim 13, wherein the fourth grid electrode is plate shaped.

17. The cathode ray tube according to claim 13, wherein the cathode ray tube is a color cathode ray tube.

* * * * *